United States Patent [19]

Butler

[11] Patent Number: 4,691,459

[45] Date of Patent: Sep. 8, 1987

[54] ARTIFICIAL AQUARIUM

[76] Inventor: George Butler, 62 Dacia St., Dorchester, Mass. 02125

[21] Appl. No.: 825,148

[22] Filed: Feb. 3, 1986

[51] Int. Cl.[4] ..... G09F 19/00

[52] U.S. Cl. ..... 40/406; 40/409; 119/5

[58] Field of Search ..... 40/406, 409; 119/5; 446/153, 159, 267; 272/8 N

[56] References Cited

U.S. PATENT DOCUMENTS

| | | | |
|---|---|---|---|
| 757,407 | 4/1904 | Mayhall | 119/5 |
| 925,209 | 6/1909 | Livermore | 119/5 |
| 930,613 | 8/1909 | Pressey | 446/153 |
| 2,751,880 | 6/1956 | Markowski | 119/5 |
| 3,106,394 | 10/1963 | Gelbert | 40/409 |
| 3,271,897 | 9/1966 | Gelinas | 40/412 |
| 3,324,573 | 6/1967 | Lavalla | 119/5 |
| 3,529,574 | 9/1970 | Kelley et al. | 119/5 |
| 3,535,805 | 10/1970 | Peiperl | 40/406 |
| 3,650,056 | 3/1972 | Walton | 40/409 |
| 3,695,607 | 10/1972 | Stouffer | 40/409 |
| 3,975,845 | 8/1976 | Mellard | 119/5 |
| 4,364,132 | 12/1982 | Robinson | 119/5 |
| 4,413,436 | 11/1983 | Ward et al. | 119/5 |
| 4,490,931 | 1/1985 | Fleemin | 40/406 |

*Primary Examiner*—Robert P. Swiatek
*Assistant Examiner*—Cary E. Stone
*Attorney, Agent, or Firm*—William Nitkin

[57] ABSTRACT

A decorative artificial aquarium with artificial fish therein moved in a circular path within the aquarium by a whirlpool pump which creates a circular current of water therein and which artificial aquarium includes a baffle to prevent the artificial fish from being sucked into the intake of the whirlpool pump.

1 Claim, 1 Drawing Figure

ARTIFICIAL AQUARIUM

BACKGROUND OF THE INVENTION

1. Field of the Invention

The device of this invention resides in the area of decorative items and more particularly relates to an ornamental aquarium.

2. Description of the Prior Art

Ornamental aquariums are known in the prior art which utilize artificial fish and other decorative items therein. Such an ornamental aquarium is seen in U.S. Pat. No. 3,975,845 to Mellard for An Ornamental Display where fish, mounted on wires, are moved within the tank in a circular fashion by a motor. Other types of artificial displays utilizing fish are known such as illustrated in U.S. Pat. No. 3,071,375 to W. A. Moore for Apparatus for Propulsion of Submersible Objects. In this patent artificial fish are propelled by mechanisms located within each fish which move their tails. Other types of artificial tanks having cartesian divers which sink and rise independently within a body of water are found in the prior art such as U.S. Pat. No. 2,525,232 to McGaughy entitled Cartesian Diver. Artificial fish have also been utilized in fishing games such as disclosed in U.S. Pat. No. 3,106,394 to Gelbart entitled Fishing Game where artificial fish having magnets therein are propelled by water currents along a course during which game individuals attempt to catch the fish with magnets located at the ends of fishing lines.

SUMMARY OF THE INVENTION

It is an object of this invention to create a highly decorative artificial aquarium which contains water, artificial fish and plantlife, and other decorative objects such as backgrounds, all of which require no care whatsoever. It is felt that such an artificial aquarium would be an ideal decoration in offices where individuals might find it difficult to care for live fish especially over periods of times such as vacations. It is also suitable for individuals who do not want the bother of caring for live fish. Live fish require feeding, cleaning, medical attention and their tanks require extensive water filters, pumps and chemicals to maintain the water in suitable condition. The device of this invention provides an artificial aquarium with artificial fish therein which move as though they were live fish and provides a maintenance-free aquarium where the only effort required is to maintain the water level in the aguarium due to water evaporation and to keep the mechanism which is electrical in nature plugged into an electrical current source so that the artificial fish operate as described below.

DESCRIPTION OF THE PREFERRED EMBODIMENT(S)

Figure 1:
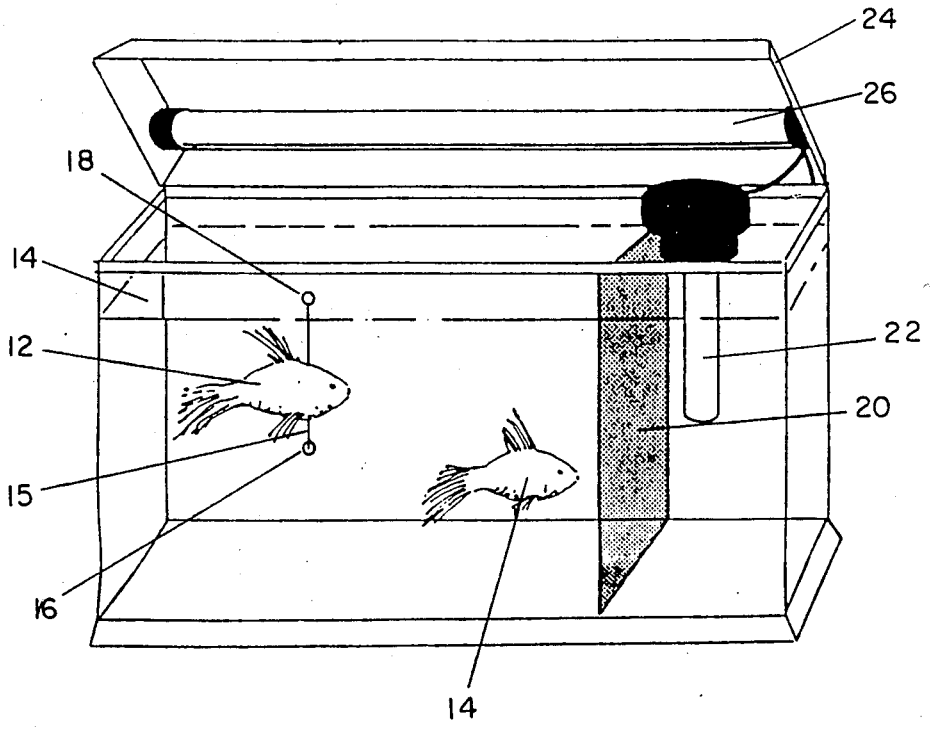
FIG. 1 illustrates the artificial aquarium of this invention.

FIG. 1 illustrates the artificial aquarium of this invention which includes tank 14 containing water therein. Such a tank could be a conventional fish tank as such as a 10-gallon tank or any size tank which will suffice for the operation of the apparatus of this invention. The tank can also include top member 24 which has lighting means such as lamp 26 incorporated therein. Such devices are commonly sold with aquariums. Although not illustrated it is envisioned that the tank will have gravel on the bottom with a plurality of artificial plastic plants embedded therein which are most life-like. One or more artificial fish 12 and 14 are positioned within the tank and must be weighted so that they will be positioned at a predetermined level within the tank and not rise to the surface or sink to the bottom. Such weight can be incorporated into each fish as ballast for equilibrium as in fish 14 or can be provided as in fish 12 where it is attached by thin monofilament lines 15 to float 18 which floats on the surface and sinker 16 which holds fish 12 downward. It has been found that such elements if they are small enough are not easily visible when the device of this invention is in operation. Whirlpool pump 22 is provided in the tank to cause a circular movement of water to occur along the walls of the tank. Whirlpool pump 22 drives the water by sucking it in from one side of the pump and forcing it out the other side of the pump, causing a circular current to form within the entire tank. Such whirlpool pumps are well known in the art, especially relating to whirlpool baths and can be adapted directly from that purpose and inserted into the tank. One such motor is the Sears & Roebuck model 2262 which will cause such a circular water current to flow within the tank. The water current causes the artificial fish which are positioned in the water to be carried by the current in circles around the tank so that they appear to be alive and moving. The circular movement of the artificial fish along with the life-like plants, lights, gravel, and background produce the desired effect that the tank contains live tropical fish.

It is important that the artificial fish not be sucked into the intake of whirlpool pump 22. To prevent this occurence, baffle member 20 is provided across the tank. This baffle member contains apertures which allow the water current to pass therethrough but which prevent the fish from passing near pump 22. Baffle member 20 can also be positioned around or cover the intake opening of whirlpool pump 22 which would prevent the artificial fish from being pulled into and staying at the intake rather than circulating around the tank. When the baffle member extends across the tank, it forms a wall separating the tank into two chambers. The first chamber contains the whirlpool pump and the second chamber contains the artificial fish moving at a predetermined level in the water.

Although the present invention has been described with reference to particular embodiments, it will be apparent to those skilled in the art that variations and modifications can be substituted therefor without departing from the principles and spirit of the invention.

I claim:

1. A decorative artificial aquarium comprising:

a rectangular tank member having two opposite transparent first and second sides and two opposite transparent third and fourth sides shorter than said first and second sides;

water contained within said tank member;

at least one artificial fish freely floating at a predetermined level within said water;

a whirlpool pump positioned in said tank adjacent to one of its shorter sides, the water flow from said pump directed to cause circular movement of water around the inside of said tank to carry said artificial fish around in a circular path in said tank member; and a baffle positioned at one end of said tank extending between said first and second sides adjacent to said whirlpool pump to prevent said artificial fish from being drawn into the intake of said whirlpool pump said baffle extending across said tank member forming a wall separating said tank member into a first and second chamber, said first chamber containing said whirlpool pump causing said circular water circulation and said second chamber containing said artificial fish moved in a circular path at a predetermined level in said water by said circular water circulation and said baffle further having a plurality of apertures defined therein allowing water flow therethrough but preventing said fish from entering said first chamber to keep said fish away from said whirlpool pump.

* * * * *